US009027626B2

(12) United States Patent
Marocco

(10) Patent No.: US 9,027,626 B2
(45) Date of Patent: May 12, 2015

(54) WINDOW EDGE SPACE FILLER AND WINDOW COVERING

(75) Inventor: Mario M. Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 210 days.

(21) Appl. No.: 13/385,228

(22) Filed: Feb. 9, 2012

(65) Prior Publication Data

US 2013/0048230 A1 Feb. 28, 2013

Related U.S. Application Data

(60) Provisional application No. 61/573,058, filed on Aug. 22, 2011.

(51) Int. Cl.
*E06B 7/16* (2006.01)
*E06B 9/58* (2006.01)
*E06B 9/327* (2006.01)

(52) U.S. Cl.
CPC .. *E06B 9/58* (2013.01); *E06B 9/327* (2013.01)

(58) Field of Classification Search
CPC ..... E06B 1/62; E06B 1/68; E06B 1/345; E06B 9/58; E06B 9/327
USPC ..... 160/40, 84.06, 172 R, 172 V, 178.1 R, 160/178.1 V; 52/202, 203, 98, 100, 211, 52/212, 217, 204.53, 204.54, 656.5, 656.7
See application file for complete search history.

(56) References Cited

U.S. PATENT DOCUMENTS

| | | | | |
|---|---|---|---|---|
| 4,335,550 | A * | 6/1982 | Johnson | 52/99 |
| 5,590,496 | A * | 1/1997 | Martin et al. | 52/213 |
| 5,953,881 | A * | 9/1999 | Sherry | 52/746.1 |
| 8,261,498 | B2 * | 9/2012 | Poirier | 52/204.53 |
| 2004/0045229 | A1 * | 3/2004 | Coslovi | 52/127.3 |
| 2009/0313921 | A1 * | 12/2009 | Poirier | 52/204.5 |
| 2012/0174514 | A1 * | 7/2012 | Nolan et al. | 52/309.1 |

* cited by examiner

*Primary Examiner* — Katherine Mitchell
*Assistant Examiner* — Scott Denion

(57) ABSTRACT

A window opening space filler for use with a window having a window opening of predetermined opening width surrounded by a window frame, to adjust the predetermined opening width to fit a window covering having a predetermined covering width, less than the opening width, and having an attachment member for attachment to the widow frame, and, a filler member separate from the attachment member and attachable to the attachment member and extending across the window opening, so that a user can reduce the width of a window opening down each side edge make the window covering fit the reduced width window opening.

6 Claims, 5 Drawing Sheets

WINDOW EDGE SPACE FILLER AND WINDOW COVERING

This application claims priority based on the filing of U.S. Provisional Application Ser. No. 61/573,058 title WINDOW EDGE SPACE FILLER AND WINDOW COVERING, inventor Mario M Marocco, filed Aug. 22, 2011.

FIELD OF THE INVENTION

The invention relates to a window covering and to edge space fillers, for filling the space along either side of a non standard window opening to permit installation of a standard width window covering, by filling the space between the side edges of the window opening, and the side edges of the window covering.

BACKGROUND OF THE INVENTION

Window openings may be of any width, depending on the building itself.

These are not usually made to any industry standard width.

Window coverings, such as shutters, shades, and blinds, must fill the width of the window space, as well as extending from top to bottom.

In the past simpler blinds and shades have been sold in a range standard widths.

Usually the range of widths covered widths, for example, of every 4 inches, ie, 30 inch, 34 inch, 38 inch, and so on. Ranges have varied from one maker to another.

The customer would specify the width of the window opening and the blind required.

The store assistant would then select an oversize blind.

The assistant would then cut down the width of the blind to the window opening width specified by the customer. The customer would then take the covering home and install it himself.

This system had the advantage that standard width coverings could be made, and sold, at lower prices.

The filling of the window opening from top to bottom was not usually a problem. The standard coverings could simply be made with excess length, which would not be apparent, once the covering was installed.

In some cases, with Venetian blinds, it was possible for the customer to adjust the length of the blind, if desired, in a relatively simple operation.

However this system, of trimming the width of coverings, involved the stores in buying special cut down machines. Assistants had to be trained in their use. Mistakes were made. Time was wasted.

Custom made coverings would solve these problems, but the costs were much higher, and customers were not willing to incur the expense.

This invention provides window opening edge space fillers. These are vertical strips, or extrusions which can attach to the side edges of the window frame (or even to the glass), and reduce the width of the window.

The fillers are adjustable and can enable the customer to reduce the width of the window opening, to one of the standard widths for window coverings, and thus accept a standard width covering.

This will mean there is no need for an assistant to cut the blind down to size.

The customer simply buys the covering and the window space fillers and installs them himself.

This will save the stores from maintaining cut down machines, and training staff.

This will also provide the store with an extra sale, ie the window space filler, each time the customer buys a standard width blind.

A further advantage is that it will now become possible for stores to stock a wider range of window coverings of different designs, and materials, all in ranges of standard widths. Coverings adaptable to this system may include Venetians, vertical blinds, shutters, shades, and roman shades, balloon shades, accordion pleat shades, and others Such a variety of blinds, in many cases, simply could not be supplied to stores as standards and then "cut down", under the old system, at all.

This will still further increase the sales volume of the stores.

BRIEF SUMMARY OF THE INVENTION

In one embodiment of the invention there is a space filler member such as an extrusion of synthetic plastic material, or a milled wooden product, or even sheet metal, with sides which can be broken away along preset break lines, to enable the customer to make the fillers fit his window and thus reduce the width of the opening.

The filler members will be secured to the window side frames.

In this way the filler members can reduce the width, along either side of the window opening, to a standard width. A window opening space filler for use with a window having a window opening of predetermined opening width surrounded by a window frame, to adjust said predetermined opening width to fit a window covering having a predetermined covering width, less than said opening width whereby said window opening width corresponds to said window covering width and comprising;

an attachment member for attachment to said widow frame; and, a filler member separate from said attachment member and attachable to said attachment member and extending across said window opening, whereby a user can reduce the width of said window opening down each side edge make the window covering fit said reduced width window opening.

Preferably the invention provides a window opening space filler for use with a window having a window opening of predetermined opening width surrounded by a window frame, to adjust said predetermined opening width to fit a window covering having a predetermined covering width, less than said opening width whereby said window opening width corresponds to said window covering width and comprising;

an attachment member for attachment to said widow frame; and, a filler member separate from said attachment member and attachable to said attachment member and extending across said window opening, whereby a user can reduce the width of said window opening down each side edge make the window covering fit said reduced width window opening.

The covering can then be installed between the two edge space filler members.

The filler members may be a Z-shaped design, with an adjustable filler portion which can be positioned at the desired width. The filler members may also be a box like shape in section, with side walls which can be broken away, to provide side edge fillers of the desired width.

In another embodiment, the invention provides a simple flat mounting strip which can be fastened flat to the edge of the window frame. A space filler strip is hinged to the mounting strip. It will extend at right angles, and lie on the glass, and in effect reduce the width of the window opening.

The hinge permits the space strip to be swung away from the glass for cleaning.

In this design the blind edges would simply overlap the space strip, leaving a gap along each edge where the blind does not meet the width of the window frame.

In yet another variation the filler can be formed in two components.

A first component would be secured to the window frame, and be provided with an attachment portion, typically either a channel or possibly an abutment.

A second component would be formed as a flat strip, with a cooperating attachment, and with break lines for adjusting the width of the flat strip.

This embodiment would have the advantage that the flat strip can be extruded in long rolls, and then simply cut to length to fit a particular window.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
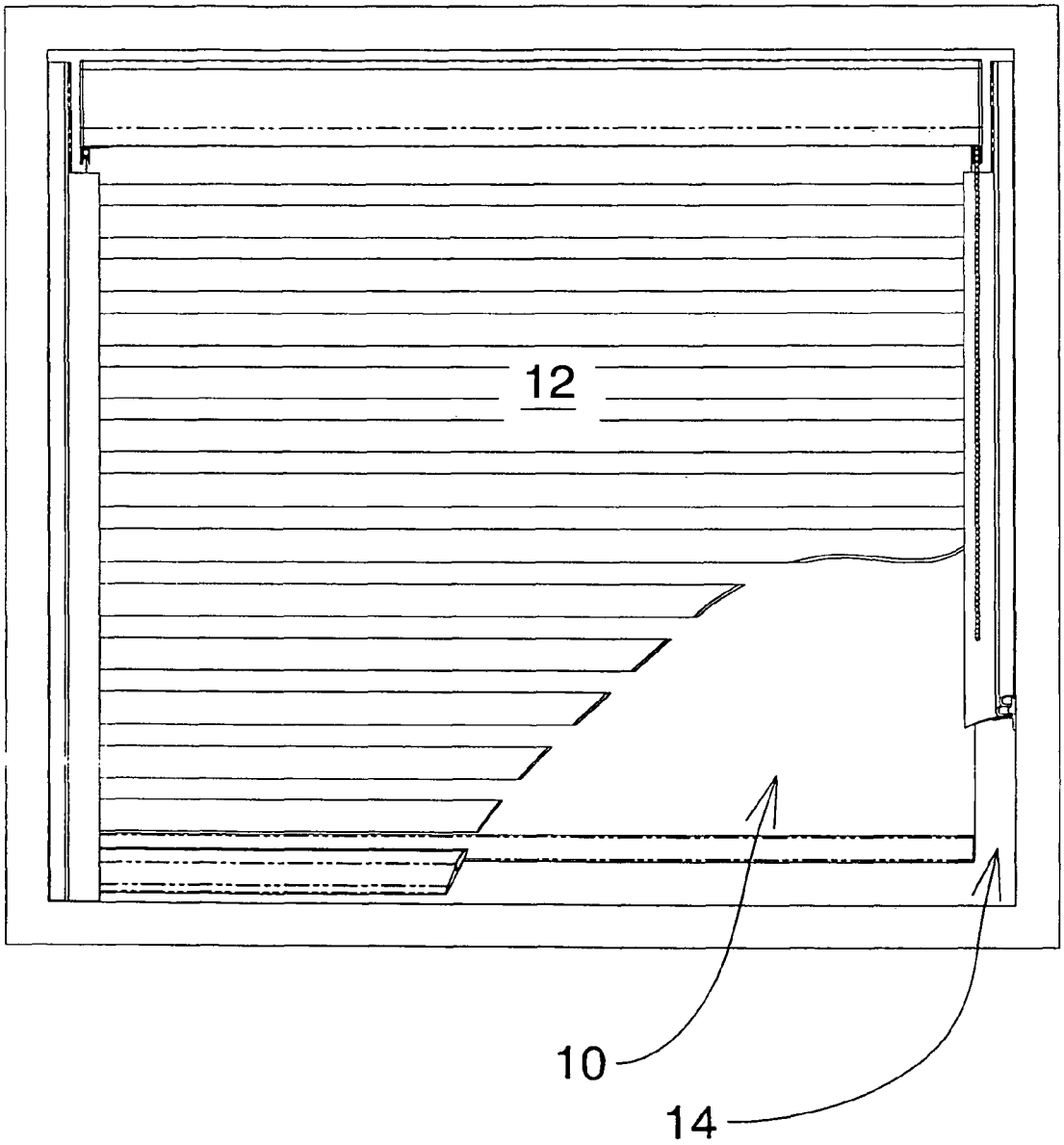
FIG. 1 is a perspective of a window covering, in this case a simple blind, showing a window opening defined by a window frame, and a blind stored in a header, and edge space fillers down each side of the window frame.

Referring to FIG. 1 it will be seen that this shows, as an example, a window opening (10) and a simple roller type basic blind (12), shown by way of example and without limitation. Such a blind may be a simple roller blind. The roller may be stored in a header. These features are well known and require no special description.

The blind (12) has a preset standard width. The width of the window opening is "non-conforming", ie it does not conform to the blind width and is greater than the blind width There are gaps (14) down each side between the edges of the blind, and the edges of the window opening. Space filler strips, described below are shown generally as (16).

These strips fill the gaps down each side of the blind (12).

Figure 2:
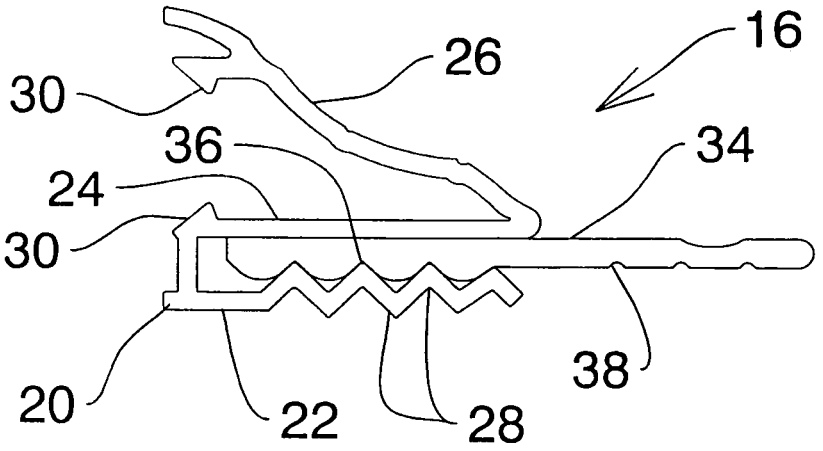
FIG. 2 is a section of a first embodiment of the invention.
Figure 3:
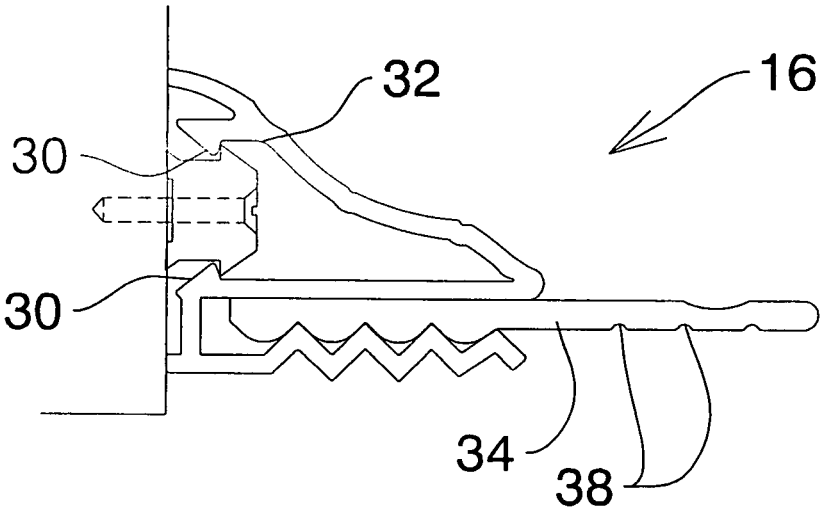
FIG. 3 is a section of the FIG. 2 embodiment showing the side filler secured by an attachment button.
Figure 4:
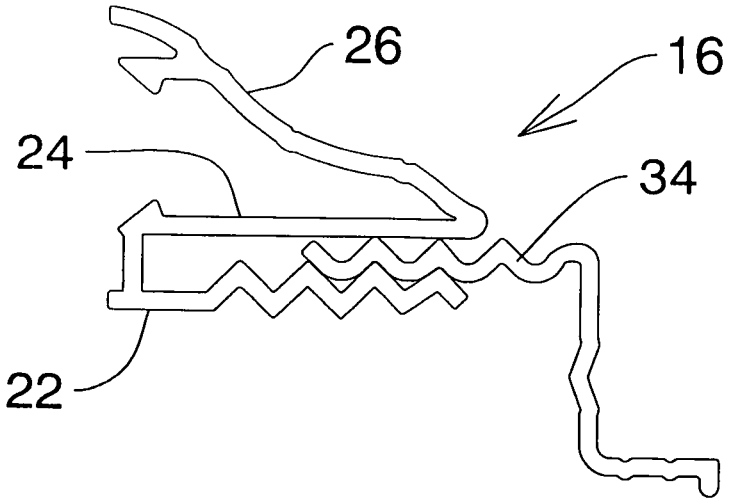
FIG. 4 is a section of the FIG. 2 embodiment showing an alternate shape for a portion of the edge filler
Figure 5:
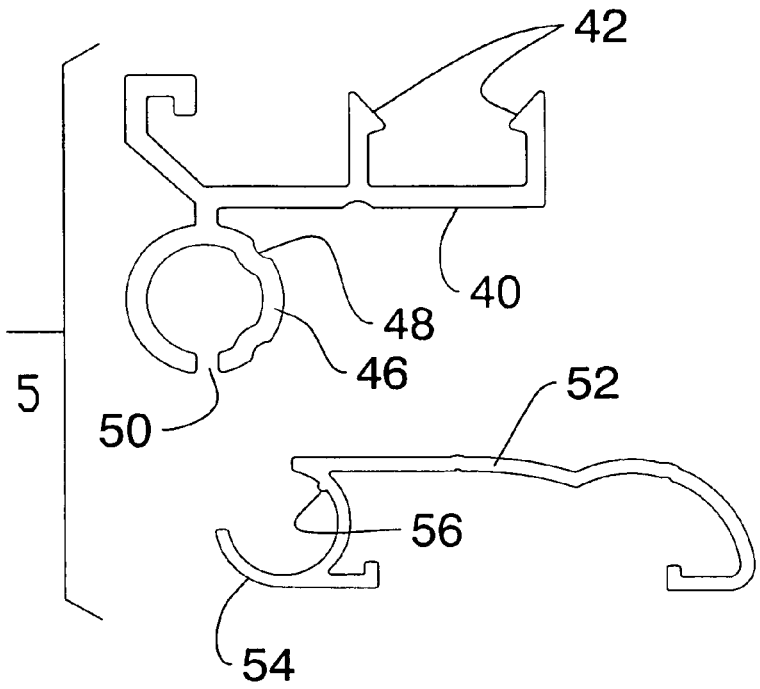
FIG. 5 is an exploded section of a second embodiment, showing a two part space filler, with one part being swing able away from the window opening for cleaning.
Figure 6:
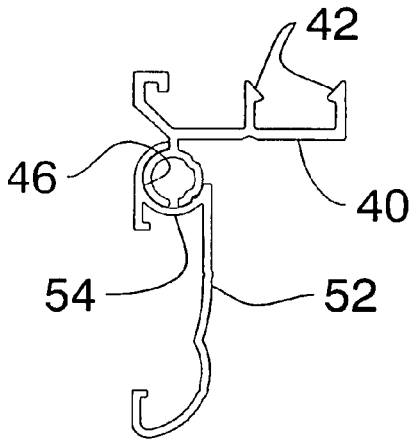
FIG. 6 is a section showing the swingable part in one position.

FIGS. 2 to 4 show a first embodiment of strip (16).

In this case there is side edge filler, in this example, is in the form of an extrusion (20), shown by way of example only and without limitation, of generally ( )-shape in section.

The side edge filler may be a wood milled member, or even a sheet metal. strip, or any suitable material.

It defines a mounting wall (22), and intermediate wall (24), and a face wall (26).

The mounting wall (22) has a plurality of friction ridges and grooves (28).

Two clip legs (30) extend from wall (24) and wall (26).

The mounting strips can be secured to the window frame, or building, by for example, screws, adhesive, hook-and-pile tape, and other systems known per se.

In this example, clip buttons (32) FIG. 3, may be secured (eg by screws) to the window frame.

Clip legs (30) snap fit over the buttons.

A filler wall (34) has grooves (36). Filler wall (34) can be inserted between walls (22) and (24) and can be adjusted in or out to provide the desired space filling function.

Break lines (38) enable a user to reduce the width of the strip as desired.

Filler wall (34), may be formed with right angle bends as shown in FIG. 4

A second embodiment is shown in FIGS. 5 to 8.

In this case a mounting wall (40) has clip legs (42) for holding buttons (44) similar to FIGS. 2 to 4.

A generally cylindrical hinge core (46) is formed on wall (40). Core (46) has a friction groove (48) and a slit opening (50), to provide a spring function and provide friction.

Figure 7:
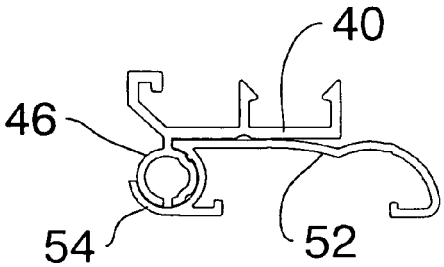
FIG. 7 is a section showing the swingable part in another position.
Figure 8:
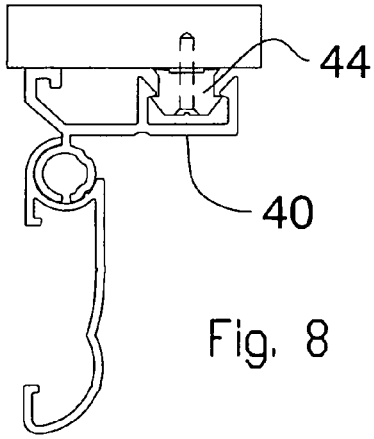
FIG. 8 is a section showing this embodiment secured by a attachment button.

A filler wall (52), has a generally semi-cylindrical hinge sleeve (54). Sleeve (54) can be sprung open and fitted onto core (46). Sleeve (54) has a friction ridge (56), which mates with groove (48) to hold wall (52) in a preset position (FIG. 7).

The filler strip can be swung over the window (FIG. 6) to provide the space filling function, and can be swung open (FIG. 7) for cleaning.

Figure 9:
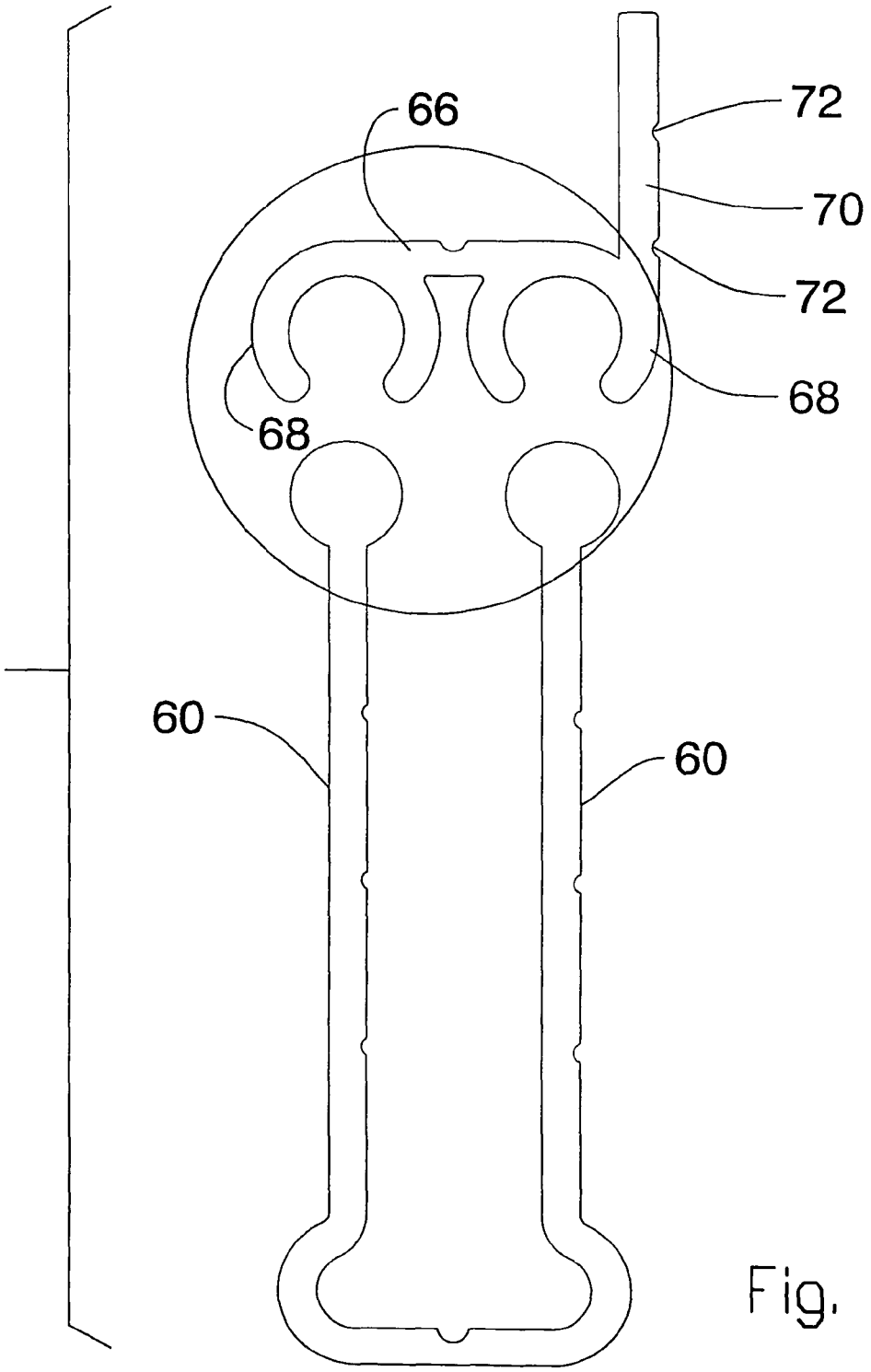
FIG. 9 is a section of a further embodiment showing a side edge filler having a box like shape in section.

FIG. 9 shows a further embodiment.

In this case a mounting strip is provided by a generally U-shaped channel defined by side walls (60) and a base wall (62).

Screws not shown can be passed through wall (62) into a window frame, to secure it.

Side walls (60) have enlarged cylindrical members (64) formed thereon.

A filler is provided by a fastening wall (66) having two semi-cylindrical channels (68), which can be fitted onto the members (64). This provides a generally hollow rectangular box-like section. (The drawings are not to scale, but the function can be well understood.)

A filler strip (70) is formed on wall (66). Strip (70) extends laterally, and covers a side portion of the window opening. Strip (70) has grooves (72) and can be separated along one of the grooves, thus providing a filler of the desired width for a specific application.

Figure 11:
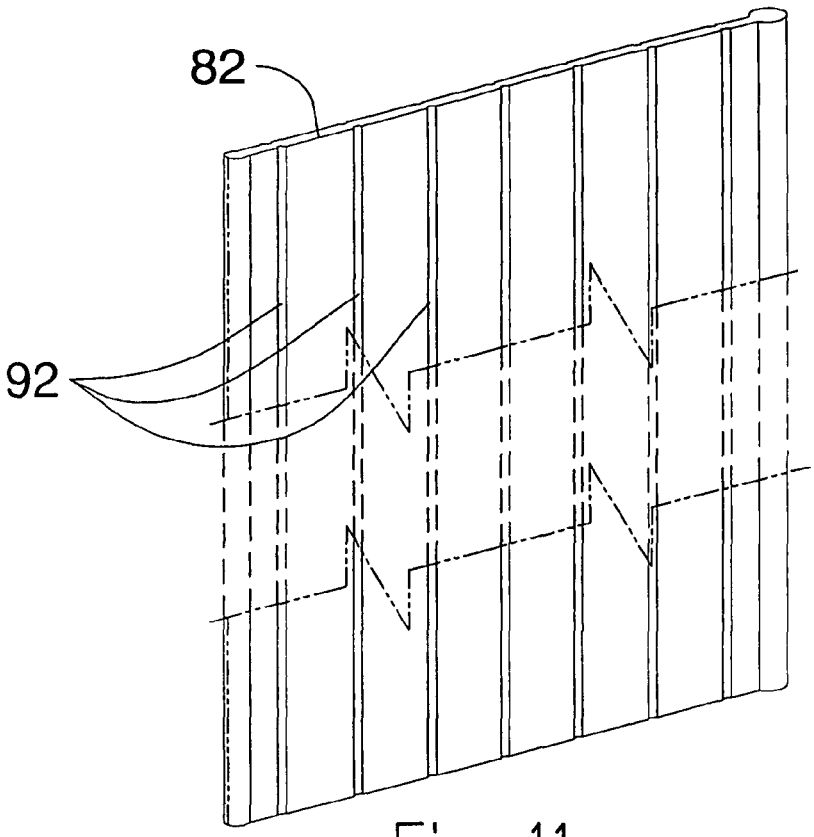
Figure 10:
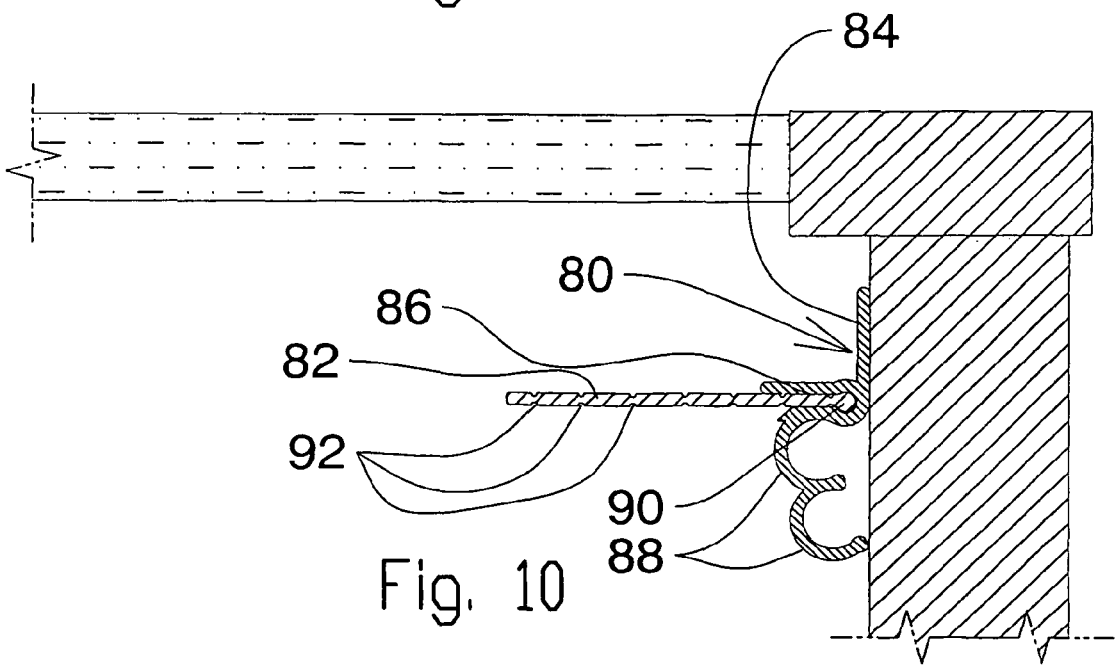
FIG. 10 is a section of a further embodiment in which the filler is formed as two components, the second component being a flat strip with break lines, for adjusting it to the correct width for a window space; and, FIG. 11 is a perspective of the flat strip of FIG. 10.

FIGS. 10 and 11 show a further embodiment consisting of a first support component (80) and a second spacer component (82).

The first component (80) has, in this example, a generally L-shaped section, forming a right angle. The flat edge (84) can be secured to a window frame.

An attachment member in the form of a channel (86) extends from the edge portion (84), in an orientation generally across the width of the window space.

Trim formations (88) in the form of parallel semi circular shapes, are formed integral with channel (86) to provide an aesthetic appearance facing towards the interior of the building.

The second component (82) is essentially a flat strip having an attachment edge portion (90) of somewhat bulbous shape in section, cooperating with channel (86) of the first component (80).

A series of spaced apart parallel break lines (92) are formed in second component or strip (82).

The break lines enable a user to simply trim the width and thus adjust the strip to fit a particular window space.

It will also be understood that these various embodiments can also be applied to the lower horizontal edge of a window frame, where the window covering does not quite extend down the full length of the window opening.

The use of this embodiment is believed to be self explanatory. After attaching the first component, the user then measure the window opening. He then breaks the strip (if necessary) along a selected break line, and inserts the attachment edge (90) in the attachment channel (86). This will then reduce the width of the window opening to the width desired for a particular standard width window covering.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A trim strip assembly for covering open spaces on opposite sides of a window which are not covered by a window blind when the blind is deployed due to a width of the blind being configured to be less than a width of the window to be covered, the trim strip assembly comprising a first component having a flat edge adapted to be secured in vertically oriented relationship to a side of a frame in which the window is mounted, the first component including an attachment member extending generally perpendicularly outwardly from the flat edge and having a pair of clamping walls defining a channel there between, a second component formed as a generally planar rigid light blocking member having an inner side portion thereof receivable within the channel so that an outer side portion thereof extends outwardly relative to the side of the frame so as to extend in front of the window, an inner edge of the inner side portion of the light blocking member being bulbous so as to frictionally seat in an inner portion of the channel, the outer side portion including a plurality of generally vertically extending parallel lines of weakness whereby an effective width of the outer side portion may selectively be made depending on a width of the open spaces to be covered on opposite sides of the window.

2. The trim strip of claim 1 wherein the first component includes an outer trim formation spaced from the flat edge which outer trim formation is adapted to engage the side of the frame of the window.

3. The trim strip of claim 2 wherein the attachment member extends outwardly between the flat edge and the trim formation.

4. The trim strip of claim 3 wherein the trim formation is integrally formed with and extends from one of the clamping walls of the attachment member.

5. The trim strip of claim 4 wherein the trim formation includes generally semi-circular formations that function as a trim enhancement for the first component along the side of the frame of the window.

6. The trim strip of claim 1 including generally semi-circular trim formations integrally formed with the first component and extending on an opposite side of the attachment member from the flat edge to thereby function as a trim enhancement for the first component along the side of the frame of the window.

* * * * *